United States Patent [19]

Turner

[11] 4,310,035

[45] Jan. 12, 1982

[54] SHIELDING IN PACKAGING OF LIQUIDS IN HEATSEALABLE FLEXIBLE PACKAGING

[75] Inventor: Howard M. Turner, Mt. Vernon, Ohio

[73] Assignee: Ludlow Corporation, Needham Heights, Mass.

[21] Appl. No.: 132,687

[22] Filed: Mar. 21, 1980

[51] Int. Cl.[3] ..... B65B 3/04

[52] U.S. Cl. ..... 141/97; 141/311 A; 141/311 R; 141/89; 141/314; 134/64 R

[58] Field of Search ..... 53/459, 469, 266 R, 53/477, 260, 261; 141/97, 311 A, 311 R, 339, 314, 89, 369, 370, 372, 114, 1, 10; 134/122, 64; 15/302

[56] References Cited

U.S. PATENT DOCUMENTS

| | | | |
|---|---|---|---|
| 3,851,444 | 12/1974 | Merat | 141/89 X |
| 3,938,214 | 2/1976 | Hodsden et al. | 134/64 R X |
| 4,020,922 | 5/1977 | Klasel | 141/314 X |
| 4,217,941 | 8/1980 | Catalano | 141/372 |

FOREIGN PATENT DOCUMENTS

| | | | |
|---|---|---|---|
| 708217 | 4/1954 | United Kingdom | 141/314 |

*Primary Examiner*—Horace M. Culver
*Attorney, Agent, or Firm*—Robert A. Cesari; John F. McKenna; Andrew F. Kehoe

[57] ABSTRACT

Apparatus and process for use in high-speed packaging of liquid-bearing substances, particularly foods. The apparatus comprises means to shield a sealable, particularly a heatsealable, portion of each of a series of packages with a protective and disposable shield means.

10 Claims, 5 Drawing Figures

SHIELDING IN PACKAGING OF LIQUIDS IN HEATSEALABLE FLEXIBLE PACKAGING

BACKGROUND OF THE INVENTION

This invention relates to high-speed packaging apparatus and, in particular, to a process whereby pouches having heatsealable closures may be rapidly processed without contamination of the seal area.

The use of flexible packaging for food has been increasing over the last 10 to 15 years. A flexible package is attractive for a number of reasons. Such packages are light in weight, compact for shipment and, when the packaging structure is properly selected, may be used as a closed container for cooking or heating the packaged product. Over the years, there has been an increase in both the quality and variety of heatsealable laminates which are suitable for such packaging applications. In order to compete more effectively with more conventional packaging techniques, it is necessary that very rapid processing of these packages be achieved. However, many foods suitable for such packaging are of such consistency that they tend to splatter and splash, in a rather unpredictable fashion, while they are being fed into the packages prior to effecting a closure. The result is that processing speeds, or other filling process parameters, must be selected to avoid such splatter.

After the invention described hereinbelow was made, and with full knowledge thereof, a search was carried out to determine whether the invention was patentable. No prior work was found which is believed to affect the patentability of the invention disclosed herein. Some protective procedures relating to heatsealing are disclosed in U.S. Pat. No. 3,432,899 to Brinkmeier et al and U.S. Pat. No. 3,488,910 to Stoger et al. U.S. Pat. No. 3,940,305 shows a fixed protective member in a metal fabrication application.

SUMMARY OF THE INVENTION

A principal object of the invention is to provide an improved high-speed process for filling packages through flexible closures which are to be subsequently sealed by a thermal process or a chemical adhesion process.

Another object of the invention is to provide automatic means to protect sealable closures of packages from splashing of liquid substances.

Another object of the invention is to provide automatic means to eliminate or substantially reduce liquid contamination from the closure areas of heatsealable pouches and thereby markedly increase the dependability of such seals under high speed processing conditions.

A further object of the invention is to provide means to utilize a positive shield member in high-speed filling of flexible packages without introducing a source of contamination into the process.

Other objects of the invention will be obvious to those skilled in the art on reading this application.

The above objects have been substantially achieved by a process wherein the closures of flexible pouches which are thermally or adhesively activatable for sealing are covered with a shielding means. The word "closure" is sometimes used herein to describe the upper areas of a package which are to be heatsealed together to close the package. Although the means can be a renewable mechanical means which is washed between filling cycles, it has been found more advantageous to provide a continuous web of disposable, apertured, shielding material which can be advanced, e.g. indexed, to provide a fresh splash shield for each filling operation. The apertures are then brought, in seriatim, into register with the spout of the filling apparatus and the sealable closures. The material surrounding the apertures is placed protectively over the sealable portion of the closure. When the closure is thus protected, it will not be contaminated even by high-speed filling processes. Even small amounts of contamination can interfere with defect-free sealing of food packages. However, with the process of the invention, it is believed that the activatable sealing processes conveniently used for sealing flexible pouches can reach the degree of dependability that is customary with packaging of food in metal cans. For example, although only small amounts of vapor or droplets can interfere with thermal sealing processes like ultrasonic welding and heatsealing, but such contamination will be substantially avoided by the process of the invention. Similarly, defective adhesive seals can be avoided when a positive seal is achieved over the area to be sealed.

In one embodiment of the invention, the shielding means is carried into shielding position on the activatable sealing surfaces by the downward movement of the filling spout structure. However, the seal itself may be moved into position by independent positioning means.

The shielding web is best selected to accommodate the particular mode of the invention. If disposable webs are used, e.g. those dispensed from a supply roll, taken up by a second roll and thereafter discarded, paper is preferred. An absorbent paper, one which will minimize any deflection or "bounce" to droplets of material, is preferred. On the other hand, in one advantageous mode of the invention, it is desirable to clean the shielding material and use it over and over again. If a roll of renewable flexible shielding material is used recycled in such an application, it is best selected for its characteristics of being readily cleaned and dryed. A thin apertured sheet having a surface of a hydrophobic organic polymer is preferred in such a structure because it is readily washed and can be dried by any of air-dry, heating, or wiping steps.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
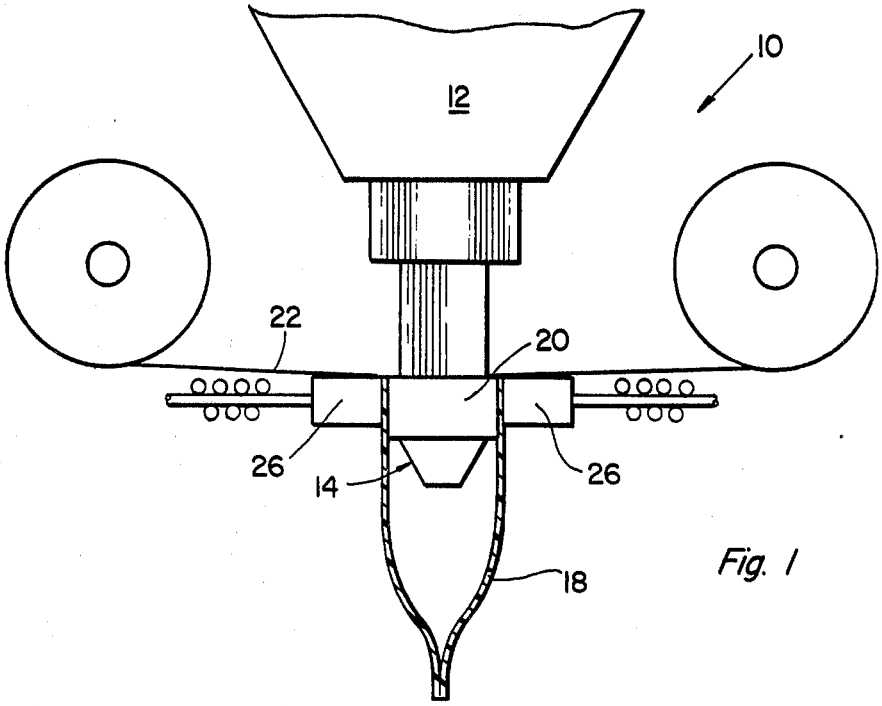
FIG. 1 is a schematic view illustrating one-mode of operating process with the shield means in shielding position and apparatus according to the invention.

Referring to FIG. 1, there is seen that a packaging apparatus 10 comprises a filling reservoir 12 having a filling spout 14 at the bottom thereof. During filling, the spout is lowered into the mouth of an unsealed pouch 16.

The spout 14 comprises a ring, or block, member 20 which forms shield-positioning means for holding a sheet 22 of protective film to accommodate spout 14 in said pouch 16 about the sealable closure area thereof. Clamp means 26 move inwardly and laterally to hold shielding sheet 22 snugly against member 20 during the fill period during which soup or some such similar material is fed into pouch 18 from reservoir 12 through spout 14.

Figure 2:
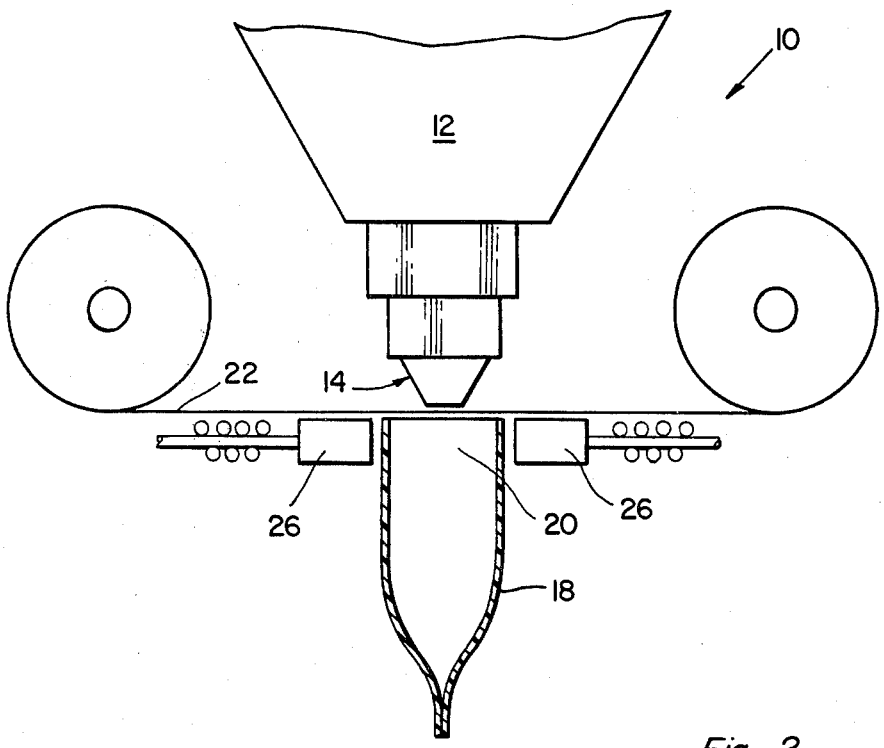
FIG. 2 is the apparatus of claim 1 with the shield in normal position.
Figure 3:
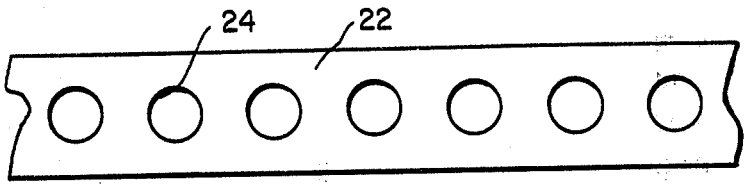
FIG. 3 is a plan view of the shield structure of the apparatus of FIGS. 1 and 2.

FIG. 2 shows clamp 26 retracted and spout 20 to allow advance of the shielding material 22.

Figure 4:
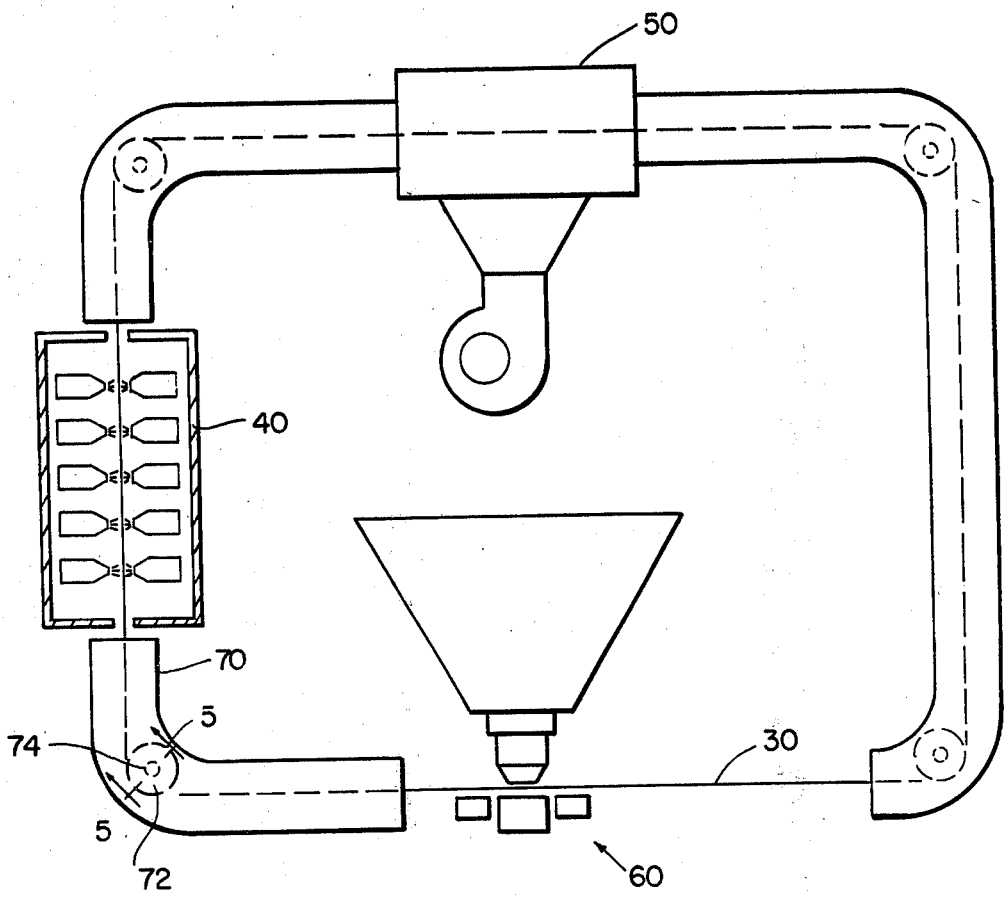
FIG. 4 illustrates schematically another embodiment of the invention using a renewable shield means.
Figure 5:
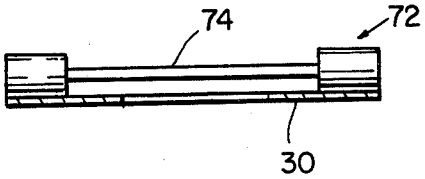
FIG. 5 is a diagram indicating how a recycled renewable shield means is kept from contacting rolls over which it passes.

FIG. 4 shows how a non-absorbent shielding material 30, can be recycled through a wash station 40 where it is sprayed with hot water, thence to a drying station 50 (which preferably is of the non-contact type utilizing hot air jets or the like) and then back to the fill apparatus at 60. During the transit, it is desirable to cover the shield with a protective tube 70. FIG. 5 shows how the precleaning-station rolls 72 should be recessed so that the areas likely to have been splashed with materials are not contacted by the rolls but pass in recesses 74 within the rolls.

In practice of the invention it is also advantageous to utilize a shield-supporting structure which aids positioning of the shield helps shield the spout itself from splash and forms part of the splash protection means of the filling apparatus. A shielding block can be utilized in conjunction with the spout structure, either as an integral part or as a separate part through which the spout moves. Such a block can help to aid the positioning of the shielding at the sealable area of the package being filled.

It is sometimes desirable to give a brief vibration to the positioning block in order to help clean the shielding means of any droplets before it is removed from the pouch and advanced. This is particularly valuable when a relatively non-absorbent film, e.g. of a hydrophobic polymer such as a polyolefin polymer, is used in the invention.

It is also to be understood that the following claims are intended to cover all of the generic and specific features of the invention herein described and all statements of the scope of the invention which might be said to fall therebetween. It will be particularly understood, by those skilled in the art, that the invention is intended to cover those novel apparatus wherein the relative position of shielding material and filling spout is changed whether by moving the spout or moving the shielding material or moving a plurality of spouts and shields as a group.

What is claimed is:

1. A process for packaging liquid compositions in packages having flexible, sealable areas for forming at the top of said packages, said process comprising the steps of a. providing a continuous roll of shielding material
b. bringing an aperture in said shielding material into register with said sealable areas and a filling spout
c. moving said shield web into shielding position over the sealable surface of, and in register with, said sealable areas
d. filling said pouch while said shield is in said shielding position
e. changing the relative position of said shielding material and said spout to present another aperture into register with another said sealable closure area.

2. A process as defined in claim 1 wherein said seal area is thermally sealed after said filling step and before any substantial contamination of the seal area.

3. A process as defined in claims 1 or 2 wherein said shielding web is moved into said shielding position by moving said filling spout into a fill position and wherein said shielding web is actuated for said indexing by movement of said spout out of said fill position.

4. A process as defined in claims 1 or 2 wherein said shielding web is formed of a water-absorbent paper.

5. A process as defined in claims 1 or 2 wherein said shielding web is a continuous web and wherein said process comprises the steps of cleaning and drying the shielding material during its travel after a first shielding use and before a subsequent shielding use.

6. A process as defined in claim 3 wherein said shielding web is formed of a water-absorbent paper.

7. In apparatus for use in rapid filling of packages with low-viscosity, splashable, liquid components, said apparatus being of the type having means to position sequentially, sealable areas which are suitable for forming closures at the top of said packages in register with a filling spout, the improvement comprising 1. shield means generally positioned between said filling spout and said sealable areas;
2. means, mounted for movement with said spout, to move said shield means downwardly into a shielding position adjacent said sealable areas;
3. means to remove said shield means from said shielding position and from register with the filling spout before advancement of another package into position beneath said spout;
4. means to replace said shield means with another shield means before again moving said filling spout downwardly into filling position.

8. Apparatus as defined in claim 7 wherein said shielding means is a strip comprising a series of apertures along said web to accommodate said filling spout and wherein said apparatus comprises means to advance a fresh shielding portion of said web with each sequential filling steps.

9. Apparatus as defined in claim 6 wherein said web is a continuous web.

10. Apparatus as defined in claims 7, 8 or 9 wherein said apparatus comprises means to clean said shield means and repeatedly return it to shielding position.

* * * * *